United States Patent [19]

Langford et al.

[11] Patent Number: 4,559,803

[45] Date of Patent: Dec. 24, 1985

[54] TOOL FOR MAKING HOLLOW ARTICLES

[75] Inventors: Edward A. Langford; Reginald L. Neale, both of Birmingham; Stephen R. James, Redditch, all of England

[73] Assignee: PFD Limited, Birmingham, England

[21] Appl. No.: 610,986

[22] PCT Filed: Oct. 3, 1983

[86] PCT No.: PCT/GB83/00246

§ 371 Date: May 10, 1984

§ 102(e) Date: May 10, 1984

[87] PCT Pub. No.: WO84/01530

PCT Pub. Date: Apr. 26, 1984

[30] Foreign Application Priority Data

Oct. 14, 1982 [GB] United Kingdom ..... 8229392

[51] Int. Cl.[4] ..... B21D 45/00

[52] U.S. Cl. ..... 72/354; 72/358; 72/359

[58] Field of Search ..... 72/344–346, 72/353, 354, 357–360

[56] References Cited

U.S. PATENT DOCUMENTS

| | | | |
|---|---|---|---|
| 3,842,646 | 10/1974 | Kuhn | 72/354 |
| 4,317,356 | 3/1982 | Stell | 72/355 |
| 4,406,146 | 9/1983 | Suzuki | 72/353 |

FOREIGN PATENT DOCUMENTS

| | | |
|---|---|---|
| 13545 | 7/1980 | European Pat. Off. . |
| 0049474 | 4/1982 | European Pat. Off. . |
| 2559239 | 7/1977 | Fed. Rep. of Germany . |
| 2830275 | 1/1980 | Fed. Rep. of Germany . |
| 1347448 | 11/1963 | France . |
| 2474909 | 8/1981 | France . |
| 52-24978 | 2/1977 | Japan . |

*Primary Examiner*—Leon Gilden

*Attorney, Agent, or Firm*—Marshall, O'Toole, Gerstein, Murray & Bicknell

[57] ABSTRACT

A tool, and method, for making the outer member of a constant velocity universal joint of the cross-groove type, the outer member being of hollow form having in its interior two sets of helical grooves of opposite hand. The tool comprises first and second parts 15, 21 mounted for axial movement relative to one another, the parts having portions 23, 17 which can be brought into and out of mutual intercalation by such axial movement, the portions 17 carrying projections 18 which form the grooves of one hand and the portions 23 carrying projections 24 which form the grooves of the other hand. When the tool is used to produce a joint outer member by being placed in a hollow blank which is forced through a die to form the material of the blank around the projections, the tool is withdrawn from the formed blank by helically withdrawing the portion 23, with its projections 24 moving along the grooves formed thereby, followed by helically withdrawing the portion 17 with its projections 18 moving along the grooves which they have formed.

4 Claims, 7 Drawing Figures

FIG. 2.
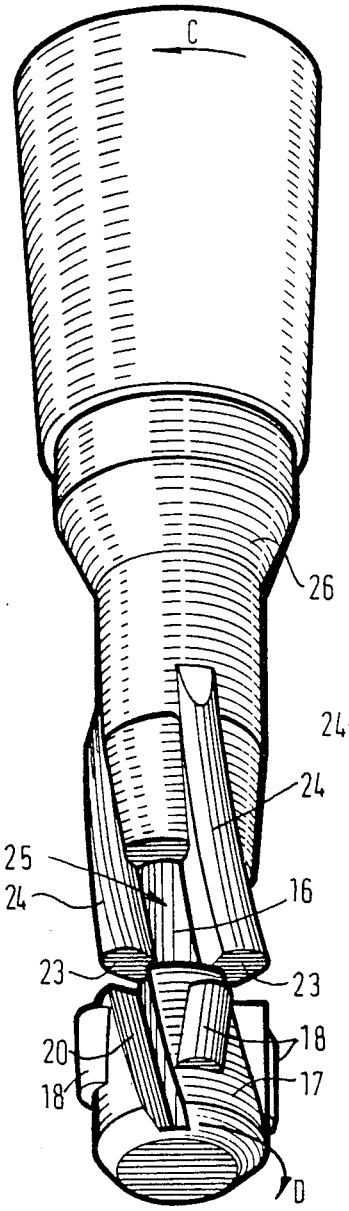
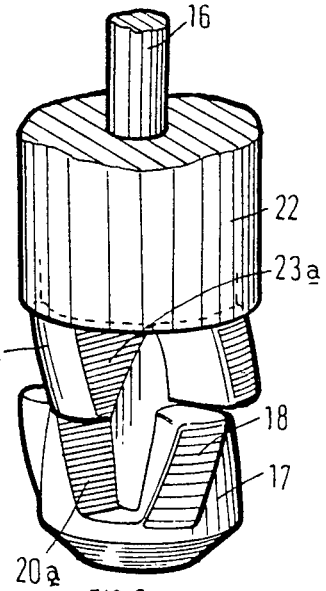
FIG. 3.

TOOL FOR MAKING HOLLOW ARTICLES

This invention relates to the manufacture of hollow articles. The invention has been developed for the manufacture of the outer member of a constant velocity universal joint of the cross-groove type. In such a joint, there is an inner member and an outer member each of which is grooved and there are two sets of helical grooves in each member, the grooves of the two sets being on helices of opposite hand. Balls are engaged in the grooves and are held in a cage and because of the crossed configuration of the grooves the balls are held in the bisector plane of the joint as the parts of the joint articulate.

Although the invention has been developed for making outer members for such cross-groove constant velocity joints it is applicable generally to the manufacture of hollow articles of the type, hereinafter referred to as being of the type specified, having at least two grooves in the bore thereof, the grooves having longitudinal axes of symmetry (as hereinafter defined) which differ (as hereinafter defined) The article may have at least two sets of grooves with the grooves in each set being spaced round the longitudinal axis of the bore and having longitudinal axes of symmetry which are the same (as hereinafter defined), the longitudinal axes of symmetry of the grooves in one set being different from the longitudinal axes of symmetry of the grooves in the other set.

By longitudinal axis of symmetry of a groove we mean the imaginary line which is equally spaced from the edges of the groove and which lies in an imaginary surface forming a continuation of the bore surface and containing said edges.

When we say that the longitudinal axes of symmetry are the same we mean that the loci of points moving in synchronism from the one ends of said axes to the other bear a fixed relation to one another. Conversely, when we say that the longitudinal axes of symmetry differ we mean that the loci of such moving points do not lie in a fixed relation to one another. Thus, for example, the axes could be on helices of different hand, or of the same hand and different pitch or on helices of different pitch and hand. Some of the axes could be straight and others could be helical.

Presently in the manufacture of outer members for cross-groove constant velocity joints the blanks are made by forging, extrusion or some other metal forming method and the grooves are then machined in the bore. Such machining operations are expensive in time and equipment besides removing material. It would be convenient to be able to form the grooves in the bore without removal of metal or even to make them with imprecise grooves which would require less machining than at present. However since the longitudinal axes of symmetry of the grooves differ as defined above a one-piece tool could not be removed from the bore after the grooves had been formed.

It is an object of one aspect of the invention to provide a tool for making hollow articles of the type specified and particularly for making outer members of constant velocity joints in which machining of the grooves may be reduced or eliminated.

According to this aspect of the invention we provide a tool for use in making a hollow article of the type specified by forming the material of the article about the tool and subsequently withdrawing the tool, the tool comprising first and second parts which are mounted so as to be capable of relative movement parallel to and about a tool axis (which when the tool is in use will be coincident with the longitudinal axis of the bore in the article) so as to bring portions of the parts into and out of mutual intercalation, each of said portions carrying at least one projection to form a groove, each groove which is formed by a projection on the first part having a longitudinal axis of symmetry which differs (as hereinbefore defined) from the longitudinal axis of symmetry of the or each groove formed by a projection on the second part and wherein, if a portion has more than one projection thereon, the projections on the portion are arranged to form grooves whose longitudinal axes of symmetry are the same (as hereinbefore defined), the arrangement of the intercalating portions being such that the first part can be withdrawn from the formed article separately from the second part with the projections on the first part moving along the grooves which have been formed about such projections.

In using such a tool to manufacture a hollow article of the type specified, the material of the article is formed around the projections while the parts are mutually intercalated and then the parts may be withdrawn from the tool in succession by relative rotation and axial movement about the tool axis as will be more fully described hereinafter.

The first part may comprise a rod having said portion at one end and the second part may comprise a sleeve surrounding the rod to be rotatable and slidable thereon, the sleeve having said portion at one end thereof.

Resilient means may act between the other ends of the parts urging said portions into mutual intercalation or this may be effected by gravity.

The tool may be mounted in a tool holder in which the sleeve is mounted for rotation in bearings.

It is an object of another aspect of the invention to provide a method of making a hollow article of the type specified having grooves in the bore thereof.

According to this aspect of the invention we provide a method of making a hollow article of the type specified from a hollow blank comprising forming recesses in the bore of the blank to receive said projections on a tool embodying the invention, placing the tool into the bore with the portions thereof mutually intercalated and the projections received in the recesses, subjecting the blank to a forming step to cause the material of the blank to be forced around said projections to form the grooves and then withdrawing the parts of the tool from the bore in succession.

Because the projections on each part of the tool form grooves whose longitudinal axes of symmetry are the same, the part may be removed from the tool. One part may be removed leaving the other part in the bore and then the second part removed.

In carrying out the method, a blank may be provided with external ribs opposite to said recesses and the forming step may be effected by extruding the blank through a die thus forcing the material of said ribs inwardly so as to be formed around the projections thus forming the grooves.

In carrying out the method each recess may be dimensioned to receive two projections, one from each of the portions. This method is particularly applicable to the manufacture of an outer member for a constant velocity joint.

The invention will now be described in detail by way of example with reference to the accompanying drawings in which:

FIG. 2 is a detail perspective view of part of the tool shown in FIG. 1;

FIG. 3 is a perspective view of a modification of the tool of FIG. 2;

Figure 1:
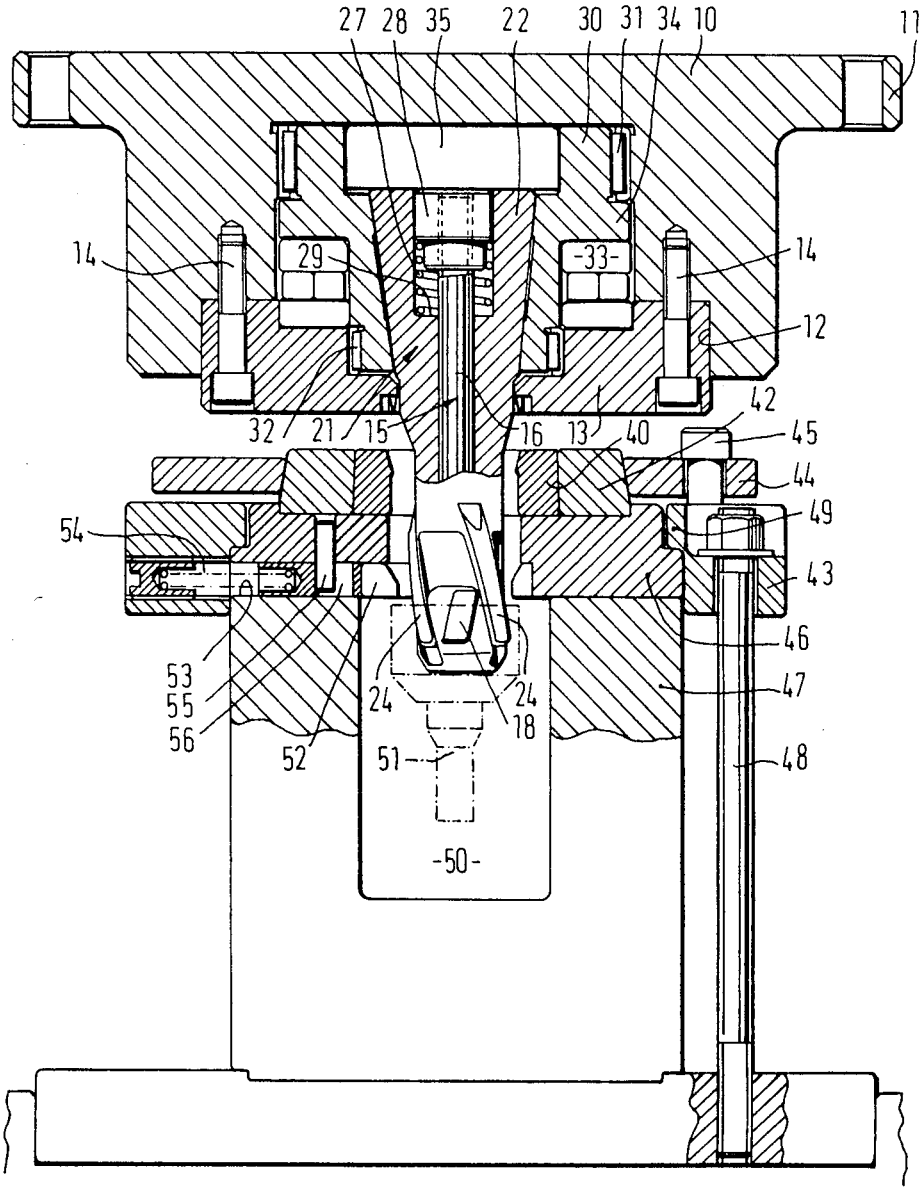
FIG. 1 is a vertical section through a tool and tool holder embodying the invention.

Referring now to the drawings, there will be described the manufacture of an outer member for a constant velocity joint having cross-grooves as referred to above. The formation of the grooves will be decribed as being effected by extrusion but other forming methods may be used.

Referring now to FIGS. 1 and 2 an upper tool holder 10 has a flange 11 whereby it may be secured by bolts, not shown, to the ram of a press. The tool holder is formed with a recess in its lower face, the recess having a lower portion 12 in which is received a keeper plate 13 secured in position by set pins 14. The tool itself comprises a first part 15 which is in the form of a rod 16 having at its lower end a portion 17 provided with projections such as 18 on fingers formed between slots such as 20. Surrounding the rod 15 is a second tool part 21 which comprises a sleeve 22 which has a bore to receive the rod 16. At its lower end the sleeve 22 is provided with fingers 23 on which are provided projections such as 24 and, between the fingers 23, are slots 25. The fingers and slots are formed in a lower portion 26 of the second tool part 21.

The fingers 23 are dimensioned and located so as to fit into the slots 20 as is shown in FIG. 1. Similarly, the slots 25 between fingers 23 of the portion 22 receive the fingers of the portion 17 which carry the projections 18. The portions 17 and 22, 23 thus mutually intercalate as shown in FIG. 1 but may be moved out of intercalation (by a helical relative movement) as shown in FIG. 2. The parts are urged to bring the portions 17 and 22, 23 to an intercalated position by means of a spring 27 which acts between a collar 28 on the rod 16 and the base of a recess 29 formed in the sleeve 22.

It will be seen from FIG. 1 that the sleeve 21 has an upper generally conical portion which is a wedge fit into a conical recess in a member 30, the member 30 being mounted for rotation about a vertical axis in the recess in the upper tool holder by means of needle roller bearings 31 and 32 and by a roller bearing 33 which supports the part 30 vertically, the bearing 33 acting between the keeper plate 13 and a flange 34 on the part 30. The sleeve 22 reacts on a thrust plate 35 received in a recess in the top of the part 30.

The lower part of the tool comprises an extrusion die 40 received in a shoulder ring 42 and is clamped in position on a stripper segment housing plate 46 by means of an apertured plate 44 having a convergent inner surface and bolted to a clamping ring 43 by set pins 45.

The clamping ring 43 holds the plate 46 on a bolster ring 47, the clamping ring 43 being held to the base of the press by rods 48 and having a portion 49 which overlaps the plate 46. The bolster ring 47 is formed with an aperture 50 to receive a hollow article after formation, such an article being indicated at 51.

The plate 46 and the bolster ring 43 carry a number of stripper fingers, one of which is indicated at 52. Each stripper finger slides in a slot 53 and is spring-urged inwardly by a spring 54, the inward movement of the stripper finger being limited by a pin 55 working in a slot 56.

A modification of the tool of FIG. 2 is shown in FIG. 3. In this, the projections 24 are provided on formations **23*a* which are wider than fingers 23 and of tapering configuration as viewed laterally. The formations 23*a* fit into correspondingly shaped recesses 20*a* in the portion 17 of the tool. Because of their increased width, formations 23*a* are stronger than fingers 23, but the two portions of the tool are brought into and out of mutual intercalation by relative helical movement in the same manner as described above with reference to FIGS. 1 and 2**.

Figure 7:
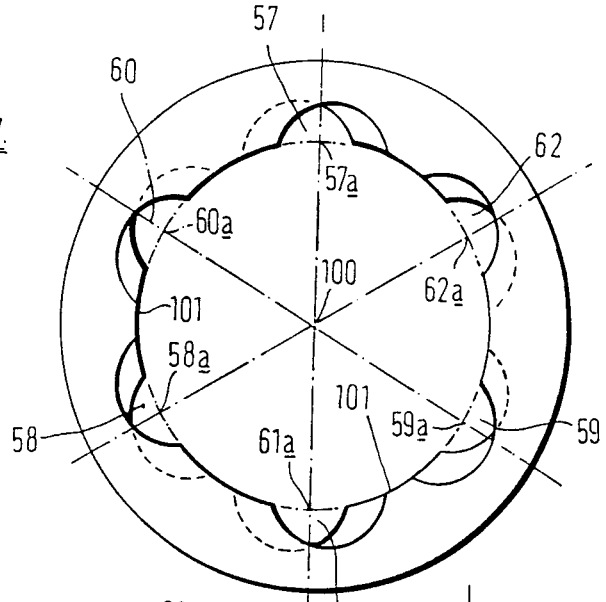
FIG. 7 is a view in the direction of the arrow B in FIG. 6 of the article shown in that figure.
Figure 6:
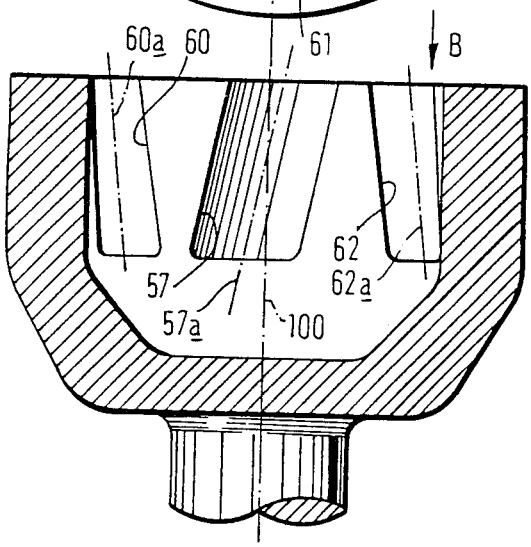
FIG. 6 is a section through a hollow article which has been made on the tooling of FIGS. 1 and 2.

FIGS. 6 and 7 show the finished hollow article in which there are two sets of three grooves each, the grooves being of arcuate section and with helical longitudinal axes of symmetry.

One set of grooves is indicated at 57, 58 and 59 and as will be seen from FIG. 6 the grooves lie on an anticlockwise helix when considered from above article. The grooves 60, 61 and 62 lie on a clockwise helix when considered from above the article. At present, in the manufacture of constant velocity joint outer members such as these the grooves are machined in a blank which has been forged or extruded. It will be seen that because the grooves are on helices of opposite hand, if the grooves were formed by a one-piece tool during extrusion of the article the tool could not be removed. However, as will be described the grooves 60, 61 and 62 are formed by the projections 24 and the grooves 57, 58 and 59 are formed by the projections 18. After forming, the second tool part 21 can be moved out of the article by a helical movement made up of a vertical movement and by rotation in the direction of the arrow C in FIG. 2. When the portion 26 is clear of the portion 17 then the portion 17 can be withdrawn from the article by an opposite helical movement comprising a vertical movement and by rotation in the direction of the arrow D in FIG. 2. By making the tool in two parts, therefore, it can be withdrawn after the article has been formed.

Figure 4:
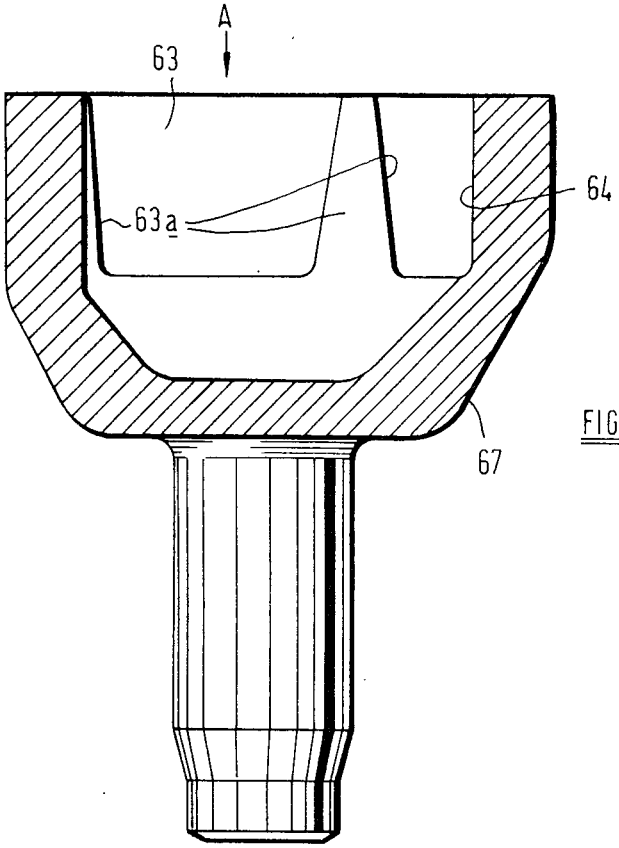
FIG. 4 is a section through a blank for making a hollow article of the type specified.
Figure 5:
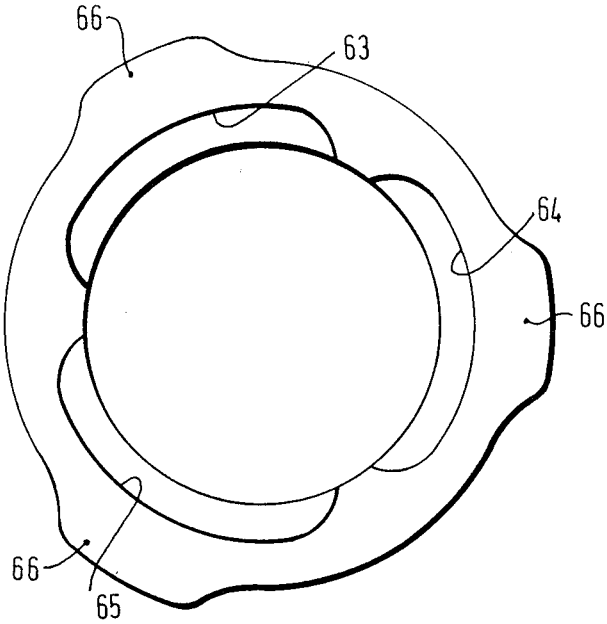
FIG. 5 is a view in the direction of the arrow A in FIG. 4 of the blank of that Figure.

FIGS. 4 and 5 show a blank for making the article and it will be seen that the blank has three recesses formed in its wall, the recesses being indicated at 63, 64 and 65. The recesses are of an axial length equal to the length of the grooves to be formed in the finished article and each recess is of such a size that it will receive one of the projections 18 and one of the projections 24. The side walls **63*a* of each recess are spaced and inclined to be engaged by the projections 18 and 24 thus locating the blank on the tool. The blank has, opposite each recess, a projecting rib 66**.

The manufacture of the hollow article takes place as follows. A blank such as shown in FIGS. 4 and 5 is formed by forging or extrusion or any other convenient method. The blank is then placed so that its tapering portion 67 rests in the extrusion die 40. The upper tool holder 11 is retracted to enable this to be done. The tool holder 11 then moves downwardly so that the tool enters the blank. It enters the blank with the parts intercalated as shown in FIG. 1 and with a pair of projections 18 and 24 in each of the recesses 63 to 66.

The upper tool holder is now moved downwardly to force the blank through the die 40. As the blank is forced downwardly the material of the ribs 66 is forced inwardly round the projections 18 and 24 to form the grooves 57 to 62. The tool pushes the blank through the die 40 and through the spring-loaded stripper fingers 52 which move against the spring loading to allow this to occur. After the article takes up the position shown in FIG. 1 at 51 the stripper fingers move back into the position shown in that figure and the tool can now be withdrawn by raising the upper tool holder 11 so that the upper surface of the article engages the under surface of the stripper fingers. The tool parts are removed successively, first the second tool part 21 is removed and moves in a helical manner to disengage the projections 24 from the grooves 60 to 62, the projections moving along the grooves. This helical movement is facilitated by the bearings 31, 32 and 33. As the tool part 21 is retracted from the article the spring 27 is compressed, the first tool part 15 remaining in the article. When the fingers 23 are clear of the slots 20 than the first part of the tool can be withdrawn from the article by moving in an opposite helical manner to the movement of the second part 21.

The grooves 57–62 each have a longitudinal axis of symmetry and the longitudinal axes of symmetry of the grooves 57–59 are the same as defined above and differ from the longitudinal axes of the symmetry of the grooves 60–62 as defined above.

Referring to FIGS. 6 and 7, the longitudinal axis of the bore of the article is indicated at 100. The longitudinal axis of symmetry of each of the grooves is indicated with the number of the groove plus the suffix letter a. The longitudinal axis of symmetry of each groove lies equidistant from the edges of the grooves and on the imaginary cylinder indicated by the full and dotted line 101, i.e. the cylinder containing the bore of the article.

In FIG. 6 the longitudinal axes of symmetry 57*a*, 60*a* and 62*a* are shown and it will be seen that the axes 60*a* and 62*a* are on a helix of one hand whereas the longitudinal axis of symmetry 57*a* is on a helix of the other hand. The longitudinal axes of symmetry of the grooves 60, 61 and 62 are the same in that a loci of points moving synchronously from one end of the axis of symmetry of each groove to the other maintain a fixed relation to one another. It is this property that enables the tool part 21 to be withdrawn from the article after it has been formed. Similarly the loci of points moving up the longitudinal axes of symmetry of the grooves 57–59 will bear a fixed relation to one another and this enables the first tool part 15 to be withdrawn from the article after it has been formed.

It will be seen that by having the tool in two parts it may be withdrawn from the article even though the grooves are on helices of opposite hand to the axis of the article.

We claim:

1. A tool for use in making a hollow article of the type specified by forming the material of the article about the tool and subsequently withdrawing the tool, the tool comprising first and second parts (15, 21) which are mounted so as to be capable of relative movement parallel to and about a tool axis (which when the tool is in use will be coincident with the longitudinal axis of the bore in the article) so as to bring portions (22, 23, 23*a*, 17) of the parts into and out of mutual intercalation, each of said portions carrying at least one projection (18,24) to form a groove, the or each groove which is formed by a projection (18) on the first part (17) having a longitudinal axis of symmetry which differs (as hereinbefore defined) from the longitudinal axis of symmetry of the or each groove formed by a projection (24) on the second portion (22, 23, 23*a*) and wherein, if a portion has more than one projection thereon, the projections on the portion are arranged to form grooves whose longitudinal axes of symmetry are the same (as hereinbefore defined), the arrangement of the intercalating portions (22, 23, 23*a*, 27) being such that the first part 17 can be withdrawn from the formed article separately from the second part (22, 23) with the projections (18) on the first part (17) moving along the grooves which have been formed about such projections (18).

2. A tool as claimed in claim 1 further characterised in that the first part comprises a rod (16) having at one end said portion (17) and the other part comprises a sleeve (22) surrounding the rod to be rotatable and slidable thereon, the sleeve (22) having at one end said portion (23, 23*a*).

3. A tool as claimed in claim 2 further characterised in that resilient means (27) acts between the other ends of the parts (15, 21) urging said portions (17, 22, 23, 23*a*) into mutual intercalation.

4. The combination of a tool as claimed in any of claims 1 to 3 with a tool holder (10) in which the sleeve is mounted for rotation in bearings (31, 32).

* * * * *